US009299294B2

(12) United States Patent
Lin et al.

(10) Patent No.: US 9,299,294 B2
(45) Date of Patent: Mar. 29, 2016

(54) DRIVING METHOD FOR ELECTROPHORETIC DISPLAYS WITH DIFFERENT COLOR STATES

(75) Inventors: Craig Lin, San Jose, CA (US); Bo-Ru Yang, Banqiao (TW)

(73) Assignee: E INK CALIFORNIA, LLC, Fremont, CA (US)

( * ) Notice: Subject to any disclaimer, the term of this patent is extended or adjusted under 35 U.S.C. 154(b) by 67 days.

(21) Appl. No.: 13/289,403

(22) Filed: Nov. 4, 2011

(65) Prior Publication Data

US 2012/0120122 A1 May 17, 2012

Related U.S. Application Data

(60) Provisional application No. 61/412,746, filed on Nov. 11, 2010.

(51) Int. Cl.
*G09G 3/34* (2006.01)
*G09G 3/20* (2006.01)

(52) U.S. Cl.
CPC ..... *G09G 3/344* (2013.01); *G09G 3/2018* (2013.01); *G09G 2320/0204* (2013.01); *G09G 2340/16* (2013.01)

(58) Field of Classification Search
CPC ..... G09G 3/344
USPC ..... 345/107
See application file for complete search history.

(56) References Cited

U.S. PATENT DOCUMENTS 4,143,947 A 3/1979 Aftergut et al.
4,259,694 A 3/1981 Liao
4,443,108 A 4/1984 Webster
4,568,975 A 2/1986 Harshbarger
4,575,124 A 3/1986 Morrison et al.
5,266,937 A 11/1993 DiSanto et al.
5,298,993 A 3/1994 Edgar et al.
5,754,584 A 5/1998 Durrant et al.
5,831,697 A 11/1998 Evanicky et al.
5,923,315 A 7/1999 Ueda et al.
5,926,617 A 7/1999 Ohara et al.
6,005,890 A 12/1999 Clow et al.
6,045,756 A 4/2000 Carr et al.
6,069,971 A 5/2000 Kanno et al.
6,111,248 A 8/2000 Melendez et al.
6,154,309 A 11/2000 Otani et al.

(Continued)

FOREIGN PATENT DOCUMENTS

CN 101727224 6/2010
WO WO 2005/004099 1/2005

(Continued)

OTHER PUBLICATIONS

U.S. Appl. No. 12/046,197, filed Mar. 11, 2008, Wang et al.

(Continued)

*Primary Examiner* — Roy Rabindranath
(74) *Attorney, Agent, or Firm* — Perkins Coie LLP

(57) ABSTRACT

The present invention is directed to a driving method for a display having a binary color system, which method can effectively improve the performance of an electrophoretic display. The method comprises applying a series of driving voltages to said pixel and the accumulated voltage integrated over a period of time from the first image to the last image is 0 (zero) or substantially 0 (zero) volt•msec.

8 Claims, 6 Drawing Sheets

(56) References Cited

U.S. PATENT DOCUMENTS

| | | | | |
|---|---|---|---|---|
| 6,531,997 | B1 * | 3/2003 | Gates et al. | 345/107 |
| 6,532,008 | B1 | 3/2003 | Guralnick | |
| 6,639,580 | B1 | 10/2003 | Kishi et al. | |
| 6,657,612 | B2 | 12/2003 | Machida et al. | |
| 6,671,081 | B2 | 12/2003 | Kawai | |
| 6,674,561 | B2 | 1/2004 | Ohnishi et al. | |
| 6,686,953 | B1 | 2/2004 | Holmes | |
| 6,796,698 | B2 | 9/2004 | Sommers et al. | |
| 6,903,716 | B2 | 6/2005 | Kawabe et al. | |
| 6,914,713 | B2 | 7/2005 | Chung et al. | |
| 6,970,155 | B2 | 11/2005 | Cabrera | |
| 6,995,550 | B2 | 2/2006 | Jacobson et al. | |
| 7,177,066 | B2 | 2/2007 | Chung et al. | |
| 7,283,119 | B2 | 10/2007 | Kishi | |
| 7,307,779 | B1 | 12/2007 | Cernasov et al. | |
| 7,349,146 | B1 | 3/2008 | Douglass et al. | |
| 7,504,050 | B2 | 3/2009 | Weng et al. | |
| 7,710,376 | B2 | 5/2010 | Edo et al. | |
| 7,733,311 | B2 | 6/2010 | Amundson et al. | |
| 7,800,580 | B2 | 9/2010 | Johnson et al. | |
| 7,804,483 | B2 | 9/2010 | Zhou et al. | |
| 7,839,381 | B2 | 11/2010 | Zhou et al. | |
| 7,952,558 | B2 | 5/2011 | Yang et al. | |
| 7,999,787 | B2 | 8/2011 | Amundson et al. | |
| 8,035,611 | B2 | 10/2011 | Sakamoto | |
| 8,044,927 | B2 | 10/2011 | Inoue | |
| 8,054,253 | B2 | 11/2011 | Yoo | |
| 8,432,387 | B2 | 4/2013 | Lee | |
| 2002/0021483 | A1 | 2/2002 | Katase | |
| 2002/0033792 | A1 | 3/2002 | Inoue | |
| 2002/0109657 | A1 * | 8/2002 | Chang | 345/92 |
| 2003/0095090 | A1 | 5/2003 | Ham | |
| 2003/0137521 | A1 | 7/2003 | Zehner et al. | |
| 2003/0193565 | A1 | 10/2003 | Wen et al. | |
| 2004/0075634 | A1 * | 4/2004 | Gates | 345/99 |
| 2004/0227746 | A1 | 11/2004 | Shih | |
| 2004/0246562 | A1 | 12/2004 | Chung et al. | |
| 2004/0263450 | A1 | 12/2004 | Lee et al. | |
| 2005/0001812 | A1 | 1/2005 | Amundson et al. | |
| 2005/0024353 | A1 * | 2/2005 | Amundson et al. | 345/204 |
| 2005/0162377 | A1 | 7/2005 | Zhou et al. | |
| 2005/0179642 | A1 * | 8/2005 | Wilcox et al. | 345/107 |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2006/0050361 | A1 | 3/2006 | Johnson | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 | 7/2006 | Zhou | |
| 2006/0187186 | A1 | 8/2006 | Zhou et al. | |
| 2006/0192751 | A1 | 8/2006 | Miyasaka et al. | |
| 2006/0262147 | A1 | 11/2006 | Kimpe et al. | |
| 2006/0262384 | A1 | 11/2006 | Chung et al. | |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0103427 | A1 | 5/2007 | Zhou et al. | |
| 2007/0109274 | A1 | 5/2007 | Reynolds | |
| 2007/0132687 | A1 | 6/2007 | Johnson | |
| 2007/0146306 | A1 | 6/2007 | Johnson et al. | |
| 2007/0159682 | A1 | 7/2007 | Tanaka et al. | |
| 2007/0182402 | A1 | 8/2007 | Kojima | |
| 2007/0188439 | A1 | 8/2007 | Kimura et al. | |
| 2007/0200874 | A1 | 8/2007 | Amundson et al. | |
| 2007/0247417 | A1 | 10/2007 | Miyazaki et al. | |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0211833 | A1 | 9/2008 | Inoue | |
| 2008/0303780 | A1 * | 12/2008 | Sprague et al. | 345/107 |
| 2009/0058797 | A1 * | 3/2009 | Hirayama | 345/107 |
| 2009/0096745 | A1 | 4/2009 | Sprague et al. | |
| 2009/0267970 | A1 | 10/2009 | Wong et al. | |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0238203 | A1 | 9/2010 | Stroemer et al. | |
| 2010/0283804 | A1 | 11/2010 | Sprague et al. | |
| 2010/0295880 | A1 | 11/2010 | Sprague et al. | |
| 2011/0096104 | A1 | 4/2011 | Sprague et al. | |
| 2011/0175945 | A1 * | 7/2011 | Lin | 345/690 |
| 2011/0216104 | A1 | 9/2011 | Chan et al. | |
| 2011/0298776 | A1 * | 12/2011 | Lin | 345/211 |
| 2012/0120122 | A1 | 5/2012 | Lin et al. | |
| 2012/0320017 | A1 | 12/2012 | Sprague et al. | |

FOREIGN PATENT DOCUMENTS

| | | |
|---|---|---|
| WO | WO 2005/031688 | 4/2005 |
| WO | WO 2005/034076 | 4/2005 |
| WO | WO 2009/049204 | 4/2009 |
| WO | WO 2010/132272 | 11/2010 |

OTHER PUBLICATIONS

U.S. Appl. No. 12/115,513, filed May 5, 2008, Sprague et al.

U.S. Appl. No. 13/004,763, filed Jan. 11, 2011, Lin et al.

U.S. Appl. No. 13/471,004, filed May 14, 2012, Sprague et al.

Kao, WC., (Feb. 2009) Configurable Timing Controller Design for Active Matrix Electrophooretic Dispaly. *IEEE Transactions on Consumer Electronics*, 2009, vol. 55, Issue 1, pp. 1-5.

Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2.

Kao, WC., Fang, CY., Chen, YY., Shen, MH., and Wong, J. (Jan. 2008) Integrating Flexible Electrophoretic Display and One-Time Password Generator in Smart Cards. *ICCE 2008 Digest of Technical Papers*, p. 4-3. (Int'l Conference on Consumer Electronics, Jan. 9-13, 2008).

Sprague, R.A. (May 8, 2011) *Active Matrix Displays for e-Readers Using Microcup Electrophoretics*. Presentation conducted at SID 2011, 49 Int'l Symposium, Seminar and Exhibition, May 15-May 20, 2011, Los Angeles Convention Center, Los Angeles, CA, USA.

* cited by examiner

DRIVING METHOD FOR ELECTROPHORETIC DISPLAYS WITH DIFFERENT COLOR STATES

This application claims priority to U.S. Provisional Application No. 61/412,746, filed Nov. 11, 2010; the content of which is incorporated herein by reference in its entirety.

FIELD OF THE INVENTION

The present invention related to a method for driving a pixel in an electrophoretic display.

BACKGROUND OF THE INVENTION

An electrophoretic display is a device based on the electrophoresis phenomenon of charged pigment particles dispersed in a solvent. The display usually comprises two electrode plates placed opposite of each other and a display medium comprising charged pigment particles dispersed in a solvent is sandwiched between the two electrode plates. When a voltage difference is imposed between the two electrode plates, the charged pigment particles may migrate to one side or the other, depending on the polarity of the voltage difference, to cause either the color of the pigment particles or the color of the solvent to be seen from the viewing side of the display.

Alternatively, an electrophoretic dispersion may have two types of pigment particles of contrasting colors and carrying opposite charges, and the two types of pigment particles are dispersed in a clear solvent or solvent mixture. In this case, when a voltage difference is imposed between the two electrode plates, the two types of pigment particles would move to the opposite ends (top or bottom) in a display cell. Thus one of the colors of the two types of the pigment particles would be seen at the viewing side of the display cell.

The method employed to drive an electrophoretic display has a significant impact on the performance of the display, especially the quality of the images displayed.

SUMMARY OF THE INVENTION

The present invention is directed to a method for driving a pixel in an electrophoretic display, through a series of image changes, from its initial color state in the first image to a color state in the last image wherein the color state of the pixel in the last image is the same as the initial color state of the pixel in the first image, which method comprises applying a series of driving voltages to said pixel and the accumulated voltage integrated over a period of time from the first image to the last image is 0 (zero) or substantially 0 (zero) volt·msec.

In one embodiment, the electrophoretic display comprises display cells filled with a display fluid comprising one type of pigment particles dispersed in a solvent.

In one embodiment, the electrophoretic display comprises display cells filled with a display fluid comprising two types of pigment particles dispersed in a solvent.

In one embodiment, the accumulated voltage integrated over a period of time from the first image to the last image is 0 volt·msec.

In one embodiment, the accumulated voltage integrated over a period of time from the first image to the last image is substantially 0 volt·msec.

In one embodiment, the substantially 0 volt·msec is defined as allowance for a ±5% variation.

In one embodiment, the substantially 0 volt·msec is defined as allowance for a ±10% variation when the electrophoretic display has threshold energy higher than 0.01V·sec.

In one embodiment, the substantially 0 volt·msec is defined as allowance for a ±15% variation when the electrophoretic display has threshold energy higher than 0.01V·sec.

In one embodiment, the substantially 0 volt·msec is defined as allowance for a ±20% variation when the electrophoretic display has threshold energy higher than 0.01 V·sec.

In one embodiment, the substantially 0 volt·msec is achieved by feeding the releasing rate of an electrophoretic display, at any given time point, into a waveform generation algorithm to generate appropriate waveforms to drive pixels.

In one embodiment, the releasing rate is determined by the resistance-capacitor (RC) constant of the electrophoretic display.

The present invention is also directed to a system for carrying out of the method as described, which system comprises a display controller comprising a display controller CPU and a look-up table, wherein when an image update is being carried out, the display controller CPU accesses a current image and the next image from an image memory and compares the two images, followed by selecting a proper driving waveform from the look up table for each pixel, based on the comparison.

BRIEF DISCUSSION OF THE DRAWINGS

FIG. 1 illustrates a typical electrophoretic display.

FIGS. 2*a*-2*c* show an example of a binary color system having one type of pigment particles dispersed in a solvent. FIGS. 2*d*-2*f* show an example of a binary color system having two types of pigment particles dispersed in a solvent.

DETAILED DESCRIPTION OF THE INVENTION

Figure 1:
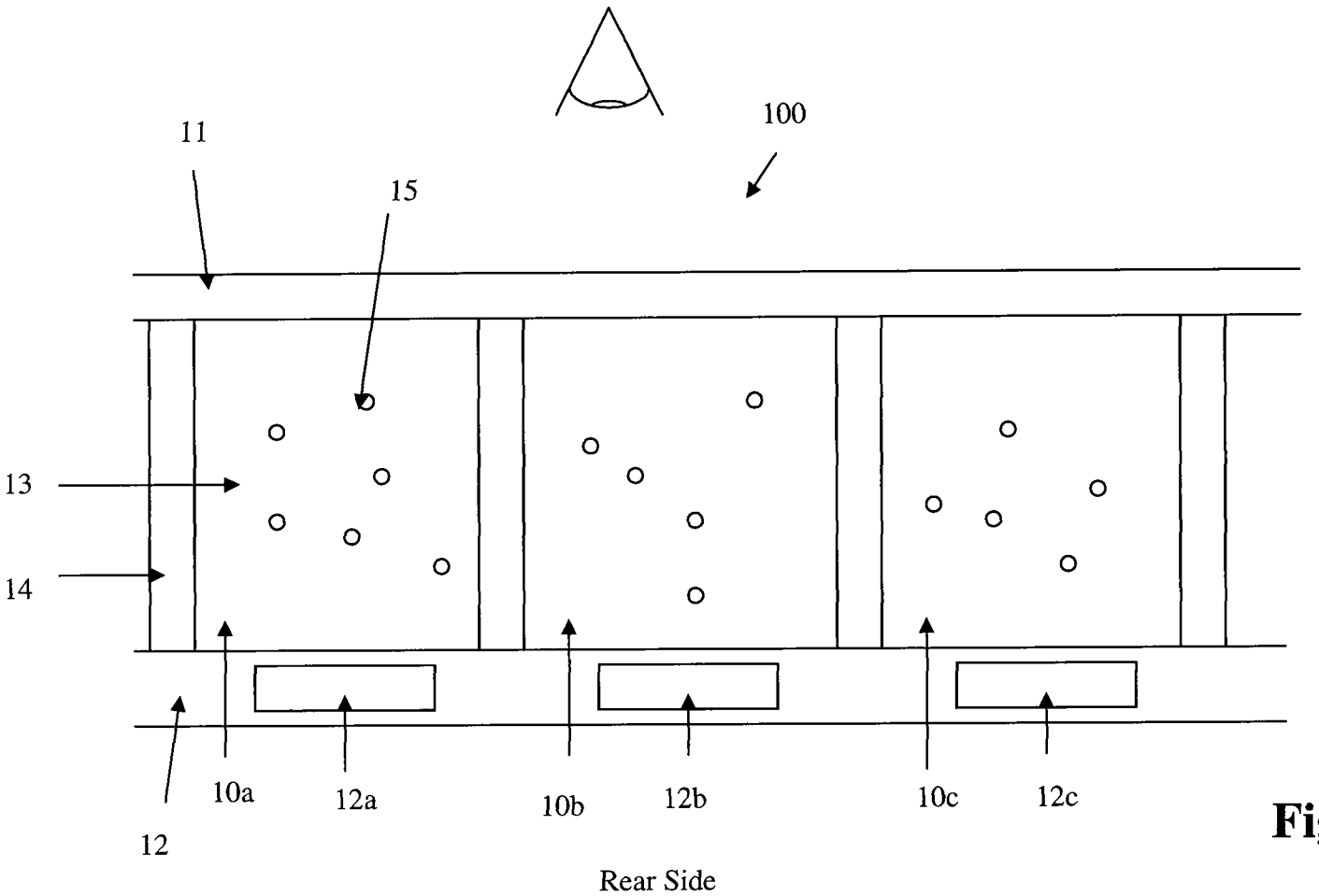

FIG. 1 illustrates an electrophoretic display (100) which may be driven by the driving method presented herein. In FIG. 1, the electrophoretic display cells 10*a*, 10*b*, 10*c*, on the front viewing side indicated with a graphic eye, are provided with a common electrode 11 (which is usually transparent and therefore on the viewing side). On the opposing side (i.e., the rear side) of the electrophoretic display cells 10*a*, 10*b* and 10*c*, a substrate (12) includes discrete pixel electrodes 12*a*, 12*b* and 12*c*, respectively. Each of the pixel electrodes 12*a*, 12*b* and 12*c* defines an individual pixel of the electrophoretic display. However, in practice, a plurality of display cells (as a pixel) may be associated with one discrete pixel electrode.

It is also noted that the display device may be viewed from the rear side when the substrate 12 and the pixel electrodes are transparent.

An electrophoretic fluid 13 is filled in each of the electrophoretic display cells. Each of the electrophoretic display cells is surrounded by display cell walls 14.

The movement of the charged particles in a display cell is determined by the voltage potential difference applied to the common electrode and the pixel electrode associated with the display cell in which the charged particles are filled.

As an example, the charged particles 15 may be positively charged so that they will be drawn to a pixel electrode or the common electrode, whichever is at an opposite voltage potential from that of charged particles. If the same polarity is applied to the pixel electrode and the common electrode in a display cell, the positively charged pigment particles will then be drawn to the electrode which has a lower voltage potential.

In another embodiment, the charged pigment particles 15 may be negatively charged.

The charged particles 15 may be white. Also, as would be apparent to a person having ordinary skill in the art, the charged particles may be dark in color and are dispersed in an electrophoretic fluid 13 that is light in color to provide sufficient contrast to be visually discernable.

In a further embodiment, the electrophoretic display fluid could also have a transparent or lightly colored solvent or solvent mixture and charged particles of two different colors carrying opposite particle charges, and/or having differing electro-kinetic properties. For example, there may be white pigment particles which are positively charged and black pigment particles which are negatively charged and the two types of pigment particles are dispersed in a clear solvent or solvent mixture.

The term "display cell" is intended to refer to a microcontainer which is individually filled with a display fluid. Examples of "display cell" include, but are not limited to, microcups, microcapsules, micro-channels, other partition-typed display cells and equivalents thereof. In the microcup type, the electrophoretic display cells 10*a*, 10*b*, 10*c* may be sealed with a top sealing layer. There may also be an adhesive layer between the electrophoretic display cells 10*a*, 10*b*, 10*c* and the common electrode 11.

In this application, the term "driving voltage" is used to refer to the voltage potential difference experienced by the charged particles in the area of a pixel. The driving voltage is the potential difference between the voltage applied to the common electrode and the voltage applied to the pixel electrode. As an example, in a binary system, positively charged white particles are dispersed in a black solvent. When no voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when no voltage is applied to a common electrode and a voltage of −15V is applied to a pixel electrode, the driving voltage in this case would be −15V and under such −15V driving voltage, the positively charged white particles would move to be at or near the pixel electrode, causing the color of the solvent (black) to be seen at the viewing side.

The term "binary color system" refers to a color system has two extreme color states (i.e., the first color and the second color) and a series of intermediate color states between the two extreme color states.

Figures 2A, 2B, 2C, 2D, 2E, 2F:
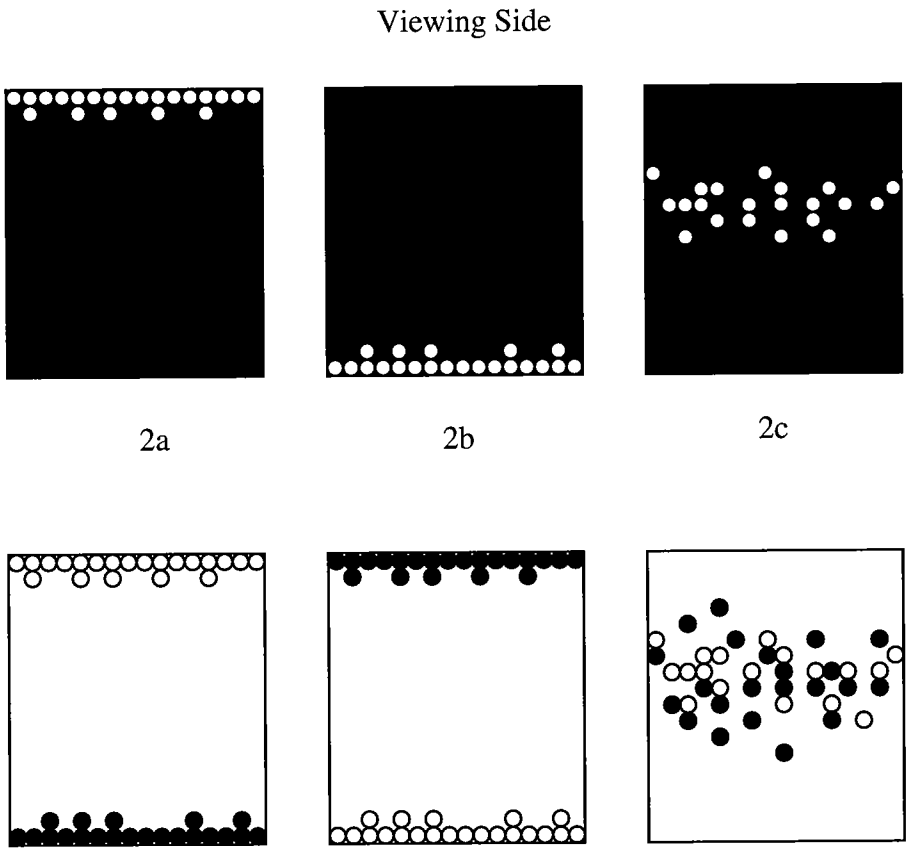

FIGS. 2*a*-2*c* show an example of a binary color system in which white particles are dispersed in a black-colored solvent.

In FIG. 2*a*, while the white particles are at the viewing side, the white color is seen.

In FIG. 2*b*, while the white particles are at the bottom of the display cell, the black color is seen.

In FIG. 2*c*, the white particles are scattered between the top and bottom of the display cell; an intermediate color is seen. In practice, the particles spread throughout the depth of the cell or are distributed with some at the top and some at the bottom. In this example, the color seen would be grey (i.e., an intermediate color).

FIGS. 2*d*-2*f* show an example of binary color system in which two types of particles, black and white, are dispersed in a clear and colorless solvent.

In FIG. 2*d*, while the white particles are at the viewing side, the white color is seen.

In FIG. 2*e*, while the black particles are at the viewing side, the black color is seen.

In FIG. 2*f*, the white and black particles are scattered between the top and bottom of the display cell; an intermediate color is seen. In practice, the two types of particles spread throughout the depth of the cell or are distributed with some at the top and some at the bottom. In this example, the color seen would be grey (i.e., an intermediate color).

It is also possible to have more than two types of pigment particles in a display fluid. The different types of pigment particles may carry opposite charges or the same charge of different levels of intensity.

While black and white colors are used in the application for illustration purpose, it is noted that the two colors can be any colors as long as they show sufficient visual contrast. Therefore the two colors in a binary color system may also be referred to as a first color and a second color.

The intermediate color is a color between the first and second colors. The intermediate color has different degrees of intensity, on a scale between two extremes, i.e., the first and second colors. Using the grey color as an example, it may have a grey scale of 8, 16, 64, 256 or more.

In a grey scale of 16, grey level 0 (G0) may be the full black color and grey level 15 (G15) may be the full white color. Grey levels 1-14 (G1-G14) are grey colors ranging from dark to light.

Each image in a display device is formed of a large number of pixels and when driving from a first image to a second image, a driving voltage is (or multiple driving voltages are) applied to each pixel. For example, a pixel in the first image may be in the G5 color state and the same pixel in the second image is in the G10 color state, then when the first image is driven to the second image, that pixel is applied a driving voltage (or multiple driving voltages) to be driven from G5 to G10.

When a series of images are driven continuously from one to the next, each pixel will be applied a series of driving voltages to be driven through a series of color states. For example, the pixel may start in the G1 color state (in the first image) and then be driven to the G3, G8, G10 and G1 color states respectively, in a series of images (i.e., images 2, 3, 4 and 5).

The driving voltage, as indicated above, may be a positive driving voltage or a negative driving voltage. Each driving voltage is applied for a period of time, usually, in the millisecond(s). In the example given above, the pixel may be applied a driving voltage of $V_1$ for a period of time, $t_1$, to be driven from G1 to G3; a driving voltage of $V_2$ for a period of time, $t_2$, to be driven from G3 to G8; then a driving voltage of $V_3$ for a period of time, $t_3$, to be driven from G8 to G10, and finally a driving voltage of $V_4$ for a period of time, $t_4$, to be driven from G10 to G1.

This example is a simple illustration in which only one driving voltage is applied to a pixel to drive the pixel from one color state to another color state. However, in most cases, when driving a pixel from one color state to another color state, there may be more than one driving voltage applied and each driving voltage is applied for a length of time. The different driving voltages may have different polarities and/or different intensities and the lengths for the different driving voltages applied may also vary. More specifically, this scenario may be expressed by the following equation for the first phase of driving in the above example:

$$V_1 \times t_1 = V_{1a} \times t_{1a} + V_{1b} \times t_{1b} + V_{1c} \times t_{1c} + \quad \text{(A)}$$

wherein $V_{1a}$, $V_{1b}$ and $V_{1c}$ are the different driving voltages applied in the first phase of driving the pixel from color G1 to color G3 and $t_{1a}$, $t_{1b}$ and $t_{1c}$ are the lengths of time applied for $V_{1a}$, $V_{1b}$ and $V_{1c}$, respectively.

The present inventors have now found a driving method for a display having a binary color system, which method can effectively improve the performance of an electrophoretic display.

The method comprises driving a pixel, through a series of image changes, from its initial color state in the first image to a color state in the last image wherein said color state of the pixel in the last image is the same as the initial color state of the pixel in the first image, which method comprises applying a series of driving voltages to said pixel and the accumulated voltage integrated over a period of time from the first image to the last image is 0 (zero) or substantially 0 (zero) volt·msec.

There is no limitation on the number of image changes in the method as long as the color states of the pixel in the first image and the last images are the same.

Following the example given above (in which the pixel is in the same color state, G1, in the first and last images) and employing the method of the present invention, the equation below will apply:

$$V_1 \times t_1 + V_2 \times t_2 + V_3 \times t_3 + V_4 \times t_4 = 0 \text{ (zero) or substantially 0 (zero) volt·msec} \quad \text{(B)}$$

As noted above in Equation (A), each component in the above equation, V×t (e.g., $V_1 \times t_1$ etc.) may be the sum of more than one applied driving voltage integrated over a period of time during which the driving voltages are applied.

Figure 3:
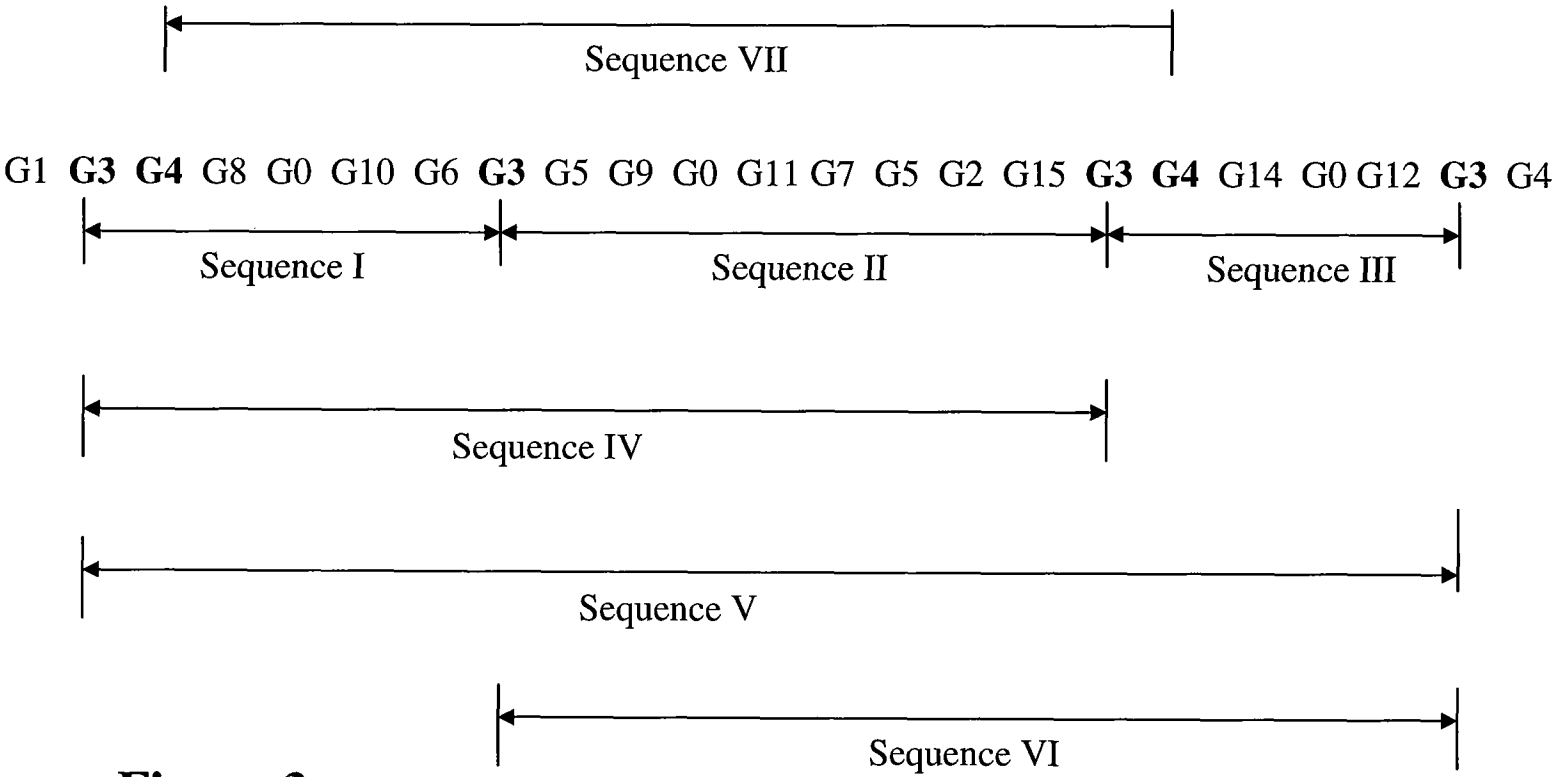
FIG. 3 illustrates the driving method of the present invention.

FIG. 3 further illustrates the present driving method. The display in this example undergoes a number (22 in fact) of image changes. As a result, a pixel undergoes a series of changes in color state. Initially, the pixel is in the G1 color state. In Sequence I as marked, the starting color and the end color of the pixel are the same, G3. Therefore the accumulated voltage integrated over the period in which the pixel is driven from G3, through G4, G8, G0, G10, G6 and ending in G3 (i.e., Sequence I) should be 0 (zero) or substantially 0 (zero) volt·msec. The same also applies to Sequences II and III.

Sequence IV is the combination of Sequences I and II. Since the initial color state and the end color state of the pixel is the same, G3, the accumulated voltage integrated over the time period of Sequence IV, is also 0 (zero) or substantially 0 (zero) volt·msec. The same also applies to Sequences V and VI.

In Sequence VII, the initial color and the end color of the pixel are the same, G4. Therefore according to the present driving method, the accumulated voltage integrated over the time period of Sequence VII should be 0 (zero) or substantially 0 (zero) volt·msec.

Figure 4:
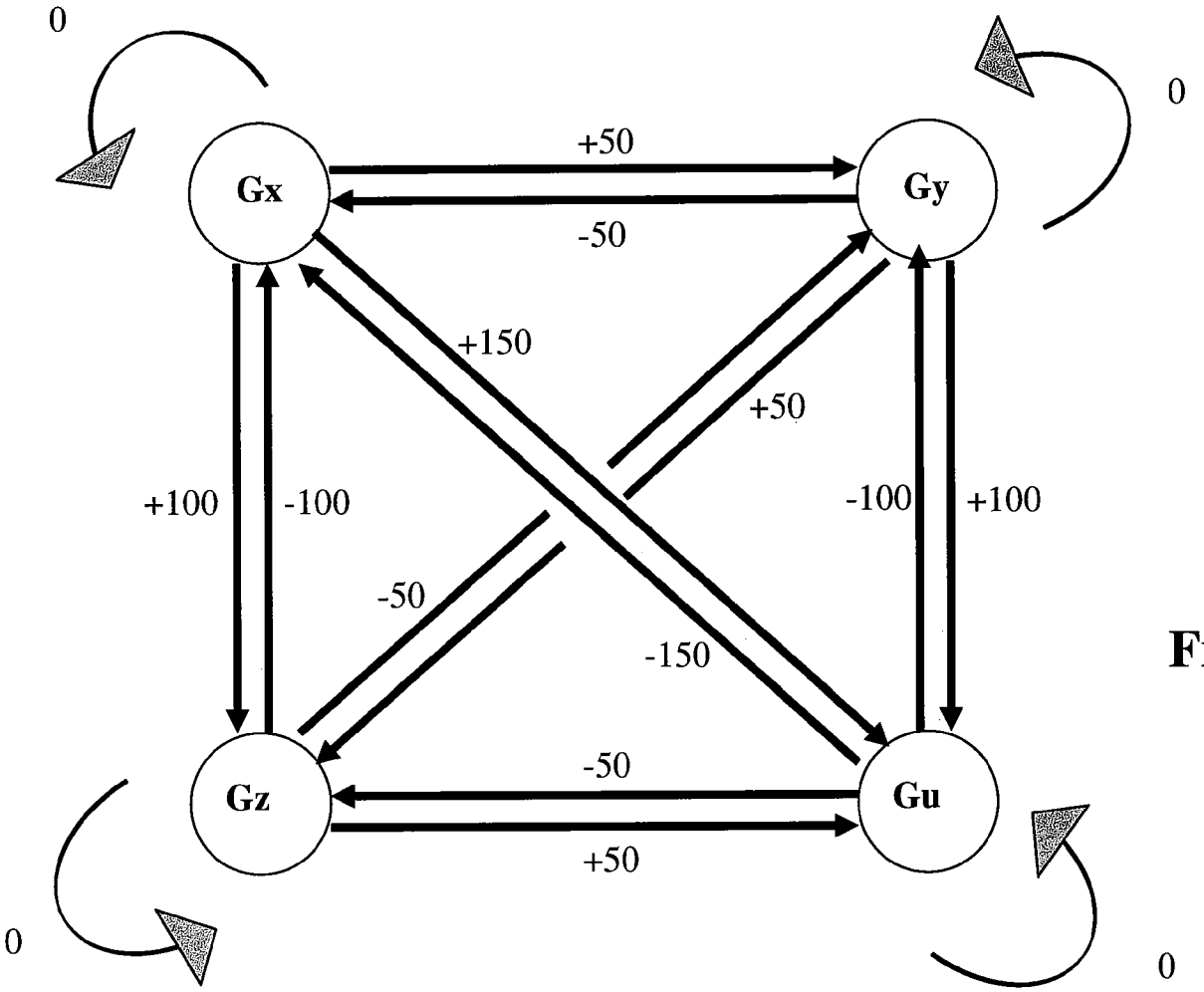
FIG. 4 is an example of the driving method of the present invention.

FIG. 4 further illustrates the driving method of the present invention. In the figure, the numbers (0, +50, +100, +150, −50, −100 or −150) are the accumulated voltage integrated over time and have the unit of volt·msec (which is not shown in the figure for brevity). The notations, $G_x$, $G_y$, $G_1$ and $G_u$ indicates grey levels x, y, z and u, respectively As shown, for example, if a pixel is driven from $G_x$ directly to $G_y$, the accumulated voltage integrated over time would be +50 volt·msec, and if a pixel is driven from $G_y$ directly to $G_x$, the accumulated voltage integrated over time would be −50 volt·msec.

When a pixel does not change its color state (i.e., $G_x$ remaining in $G_x$ or $G_y$ remaining in $G_y$), the accumulated voltage integrated over time is 0 (zero) volt·msec. The value of zero could be resulted from a number of possibilities. For example, it may be resulted from no driving voltage being applied. It may be resulted from a +V being applied following by a −V and both driving voltages being applied for the same length of time.

In the case of driving a pixel from $G_x \rightarrow G_z \rightarrow G_y \rightarrow G_x$, the image undergoes three changes. The accumulated voltage integrated over time would be (+100)+(−50)+(−50)=0 (zero) volt·msec.

If the image undergoes six changes and a pixel is driven from $G_u \rightarrow G_x \rightarrow G_y$, $G_z \rightarrow G_x \rightarrow G_y \rightarrow G_u$, the accumulated voltage integrated over time would be (−150)+(+50)+(+50)+(−100)+(+50)+(+100)=0 (zero) volt·msec.

While in this example, the accumulated voltage integrated over time is shown to be zero volt·msec. In practice, the method is as effective if the accumulated voltage integrated over time is substantially zero volt·msec.

In one embodiment, the term "substantially zero volt·msec" may be defined as allowance for a ±5% variation, which is equivalent to the accumulated voltage integrated over time for driving a pixel from one extreme color state (i.e., the first color) to the other extreme color state (i.e., the second color) in one pulse (i.e., by one driving voltage) times ±5%, per image update. For example, if the accumulated voltage integrated over time for driving a pixel from the full black state to the full white state in one pulse is 3,000 volt·msec (e.g., 15 volt×200 msec), the term "substantially zero volt·msec" would be +150 volt·msec, per image update. The ±5% allowable variation is suitable for a typical electrophoretic display panel. However, this allowable variation may shift higher or lower, depending on the quality of the display panel and driving circuitry, etc.

In one embodiment, when the electrophoretic display has threshold energy higher than 0.01V·sec, the term "substantially zero volt·msec" may be defined as allowance for a ±20% variation, preferably a ±15% variation or more preferably a ±10% variation.

In a further embodiment, the term "substantially zero volt·msec" may be determined based on the resistance-capacitor (RC) constant of an electrophoretic display panel. In this case, part of the accumulated voltage integrated over time may be transformed into kinetic energy of the particles, while the rest may be stored in the form of potential energy between the particles, counter-ions, solvent molecules, substrates, boundaries and additives. This potential energy would tend to release after the external field is removed. The releasing rate may be a linear, parabolic, exponential or any kind of polynomial function, depending on the material properties. To simplify this model, the potential releasing rate can be regarded as the discharging rate of an electrophoretic display. Therefore, the discharging rate can be further described by the RC constant of the display.

Figure 5:
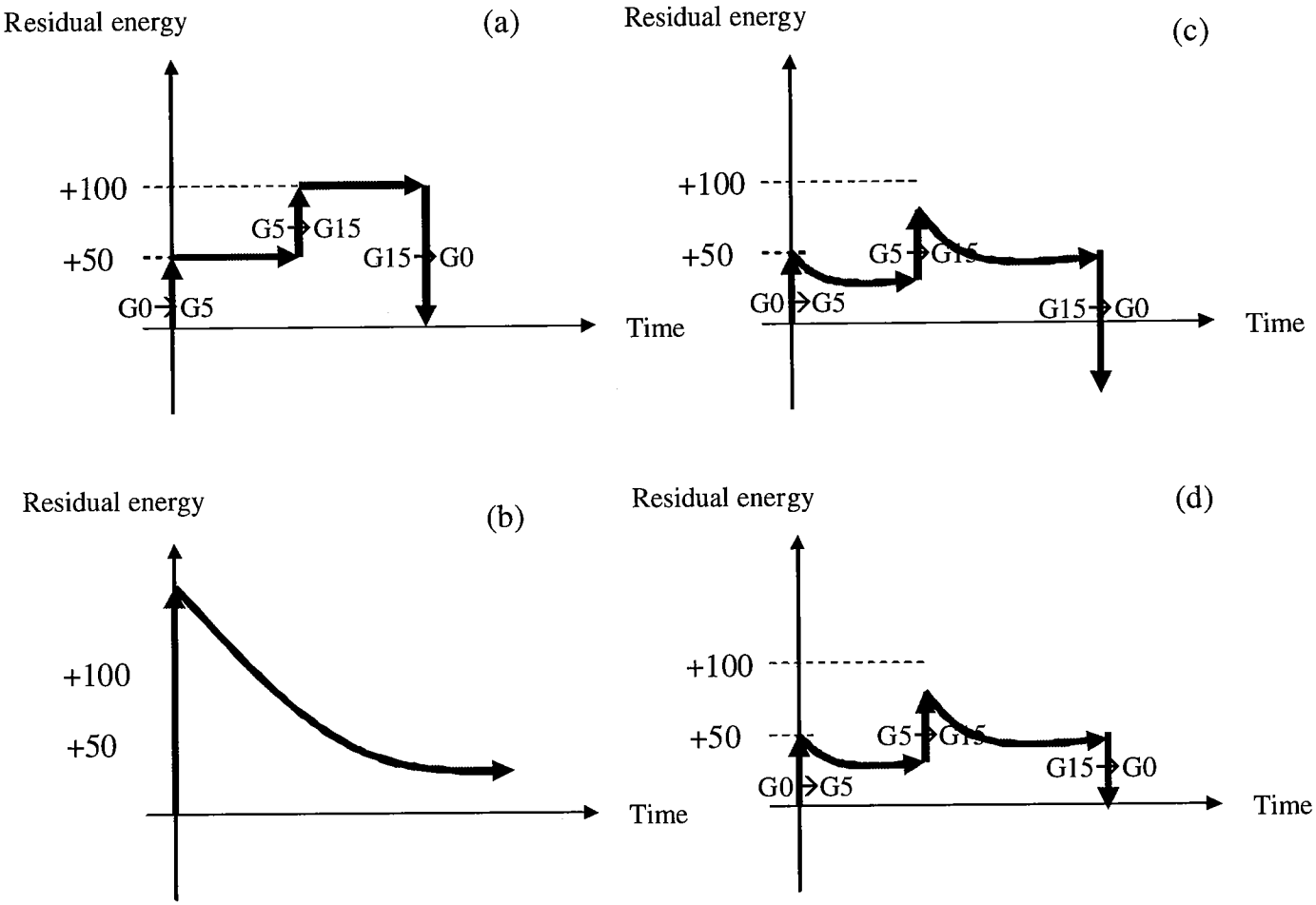
FIG. 5 (*a*-*d*) illustrates the phenomenon of releasing rate of an electrophoretic display.

As shown in FIG. 5*a*, if the releasing rate is negligible, the calculation of the voltage integrated over time would be straight-forward.

However, in practice, the releasing rate, as shown in FIG. 5*b*, is more likely to occur. Therefore it has to be taken into consideration.

FIG. 5*c* shows a version of FIG. 5*a*, with the releasing rate taken into account. It can be seen, in this case, that the accumulated voltage integrated over time is not zero.

In FIG. 5*d*, the accumulated voltage integrated over time is substantially zero, which is the target of the present invention. The scenario as shown in FIG. 5*d* may be achieved by feeding the releasing rate of the residual energy of an electrophoretic display, at any given time point, into a waveform generation algorithm to generate appropriate waveforms for driving pixels to the desired states.

The release rate may be impacted by environmental conditions such as temperature and humidity or by the image history.

Figure 6:
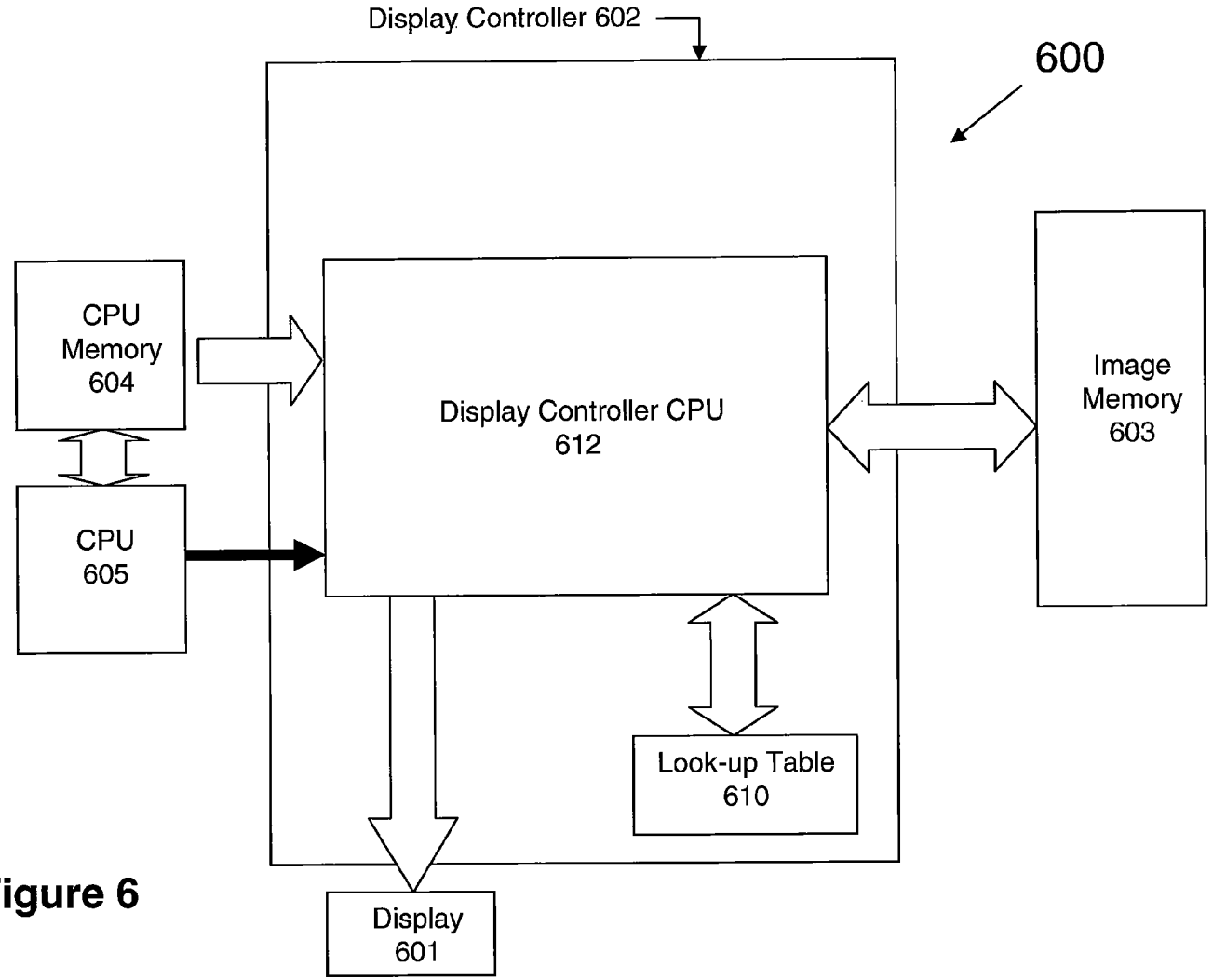
FIG. 6 illustrates a system which may be used to carry out the driving method of the present invention.

FIG. 6 demonstrates a system which may be used to carry out the method of the present invention. The system (600), as shown, comprises a display controller 602 which has a CPU of the display controller 612 and a lookup table 610.

When an image update is being carried out, the display controller CPU 612 accesses the current image and the next image from the image memory 603 and compares the two images. Based on the comparison, the display controller CPU 612 consults the lookup table 610 to find the appropriate waveform for each pixel. More specifically, when driving from the current image to the next image, a proper driving waveform is selected from the look up table for each pixel, depending on the color states of the two consecutive images of that pixel. For example, a pixel may be in the white state in the current image and in the level 5 grey state in the next image, a waveform is chosen accordingly.

The selected driving waveforms are sent to the display 601 to be applied to the pixels to drive the current image to the next image. The driving waveforms however are sent, frame by frame, to the display.

While the present invention has been described with reference to the specific embodiments thereof, it should be understood by those skilled in the art that various changes may be made and equivalents may be substituted without departing from the scope of the invention. In addition, many modifications may be made to adapt a particular situation, materials, compositions, processes, process step or steps, to the objective, spirit and scope of the present invention. All such modifications are intended to be within the scope of the claims appended hereto.

What is claimed is:

1. A method for driving a pixel in an electrophoretic display from an initial color state in a first image, wherein the initial color state is an intermediate color state between a first color state and a second color state, to a color state in a last image, wherein said color state of the pixel in the last image is the same as the initial color state of the pixel in the first image, the method comprises applying a series of driving voltages to said pixel to cause the pixel to go through at least four distinct color states wherein the at least four distinct color states are also different from the initial color state of the pixel, and the accumulated driving voltage integrated over a period of time from the initial color state to the color state in the last image is 0 (zero) or substantially 0 (zero) volt•msec which is defined as allowance for a ±5% variation; and is achieved by feeding a releasing rate of the electrophoretic display, at any given time point, into a waveform generation algorithm to generate appropriate waveforms to drive pixels.

2. The method of claim 1, wherein said electrophoretic display comprises display cells filled with a display fluid comprising one type of pigment particles dispersed in a solvent.

3. The method of claim 1, wherein said electrophoretic display comprises display cells filled with a display fluid comprising two types of pigment particles dispersed in a solvent.

4. The method of claim 1, wherein said accumulated driving voltage integrated over a period of time from the initial color state to the color state in the last image is 0 volt•msec.

5. The method of claim 1, wherein said accumulated driving voltage integrated over a period of time from the initial color state to the color state in the last image is substantially 0 volt•msec.

6. The method of claim 1, wherein the releasing rate is determined by the resistance-capacitor (RC) constant of the electrophoretic display.

7. A method for driving a pixel in an electrophoretic display from an initial color state in a first image, wherein the initial color state is an intermediate color state between a first color state and a second color state, to a color state in a last image, wherein said color state of the pixel in the last image is the same as the initial color state of the pixel in the first image, the method comprises applying a series of driving voltages to said pixel to cause the pixel to go through at least four distinct color states wherein the at least four distinct color states are also different from the initial color state of the pixel, and the accumulated driving voltage integrated over a period of time from the initial color state to the color state in the last image is 0 (zero) or substantially 0 (zero) volt•msec which is defined as allowance for a ±10% variation when the electrophoretic display has threshold energy higher than 0.01V·sec; and the 0 or substantially 0 volt•msec is achieved by feeding a releasing rate of the electrophoretic display, at any given time point, into a waveform generation algorithm to generate appropriate waveforms to drive pixels.

8. A system for carrying out of the method of claim 1, which system comprises a display controller comprising a display controller CPU and a look-up table, wherein when an image update is being carried out, the display controller CPU accesses a current image and a next image from an image memory and compares the two images, followed by selecting a proper driving waveform from the look up table for each pixel, based on the comparison.

* * * * *